US006471266B1

(12) United States Patent
Yi

(10) Patent No.: US 6,471,266 B1
(45) Date of Patent: Oct. 29, 2002

(54) DOOR LATCH COVER FOR AUTOMOTIVE VEHICLE

(75) Inventor: Bong-Chu Yi, Ulsan (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/577,267

(22) Filed: May 23, 2000

(30) Foreign Application Priority Data

Sep. 20, 1999 (KR) ..... 99-40360

(51) Int. Cl.[7] ..... E05B 17/00
(52) U.S. Cl. ..... 292/346; 292/1
(58) Field of Search ..... 292/346, 1, DIG. 2

(56) References Cited

U.S. PATENT DOCUMENTS 4,628,300 A * 12/1986 Amato ..... 340/542
4,902,058 A * 2/1990 Ohhashi et al. ..... 292/346 X
5,435,609 A * 7/1995 Igata et al. ..... 292/346
5,676,002 A * 10/1997 Hoeptner, III ..... 292/346 X
5,709,420 A * 1/1998 Umino ..... 292/216
5,988,712 A * 11/1999 Segelin ..... 292/346

FOREIGN PATENT DOCUMENTS

GB 823616 * 11/1959 ..... 292/1

* cited by examiner

*Primary Examiner*—Gary Estremsky
(74) *Attorney, Agent, or Firm*—Christie, Parker & Hale, LLP

(57) ABSTRACT

A door latch cover for automotive vehicle, the door latch cover fixedly arranged to encompass a door latch connected by a door lock actuator to be locked and to be unlocked and so constructed as to prevent the door latch from being actuated from outside through a door glass and a weather strip, wherein the door latch cover is integrally formed with an extended for blocking an upper part of the door lock actuator and for preventing the door lock actuator from being actuated from outside, such that once a door is locked, the door latch and the door lock actuator are prevented from being forcibly unlocked from outside by odd object such as steel ruler or the like, thereby blocking an unlocking of the door and reducing the number of assembly process at the door latch assembly as well.

4 Claims, 6 Drawing Sheets

DOOR LATCH COVER FOR AUTOMOTIVE VEHICLE

BACKGROUND OF THE INVENTION

1. Field of the Invention

The present invention relates to a door latch cover for an automotive vehicle, and more particularly to a door cover for an automotive vehicle adapted to be coupled to a latch installed at a door of an automotive vehicle for preventing a locked door from being externally unlocked and foreign objects from being infused into a door latch.

2. Description of the Prior Art

Generally, a door of an automotive vehicle(hereinafter referred to as door) is mounted with a door latch for locking and unlocking the door and a striker is also disposed at a pillar of the body of the vehicle so as to be joined to the door latch.

The door latch assembly includes, as illustrated in FIG. 1, a door latch 3 so disposed as to be exposed to a facing side of door hinge in a door 1 comprising an inner panel and an outer panel, a door latch cover 10 for encompassing the door latch 3, an outer handle (O) connected to a rod (L) for actuating the door latch 3, and a door lock actuator 5 connected to the rod (L) for restricting/releasing the actuation of the door latch 3 and encompassed by a door lock actuator cover 20.

In other words, the door latch 3 and the door lock actuator 5 are respectively encompassed by each cover 10 and 20, where the covers 10 and 20 serve to prevent infuse of foreign objects into the door latch 3 and the door lock actuator 5 and avoid odd objects such as steel ruler and the like from being inserted in between a door glass (not shown) and a weather strip (not shown) to thereby prevent the door latch 3 and the door lock actuator 5 from being actuated.

The door latch cover 10 and the door lock actuator cover 20 are coupled by respectively being inserted into a protruder 30 formed at the door latch 3 and another protruder (not shown) formed at the door lock actuator 5, where bosses 11 and 21 each formed at predetermined positions of the door lock actuator cover 20 and the door latch cover 10 are inserted by the protruder 30 formed at a bracket 32 of the door latch 3, as illustrated in FIGS. 2*a*, 2*b* and 3.

Furthermore, each cover 10 and 20 is formed with a plurality of incised parts 12 such that rod (L) and the like provided to connect to other parts do not interfere with the covers 10 and 20 while the covers 10 and 20 encompass the door latch 3 and the door lock actuator 5.

However, there is a problem in that, when the door latch and the door lock actuator are inserted while the door latch cover and the door lock actuator cover are respectively manufactured, assembly should be made without interference from respective cover and rod when respective covers are installed, resulting in decrease of assembly efficiency.

Furthermore, there is another problem in that the door latch cover is fitted into the door latch to thereby frequently generate a movement or disengagement of the cover due to vibration of an automotive vehicle, such that the door latch or door lock actuator are actuated to open the door, causing a fear of theft or robbery.

SUMMARY OF THE INVENTION

The present invention is disclosed to solve the aforementioned problems and it is an object of the present invention to provide a door latch cover for automotive vehicle adapted to allow one door latch cover to encompass a door latch and a door lock actuator, thereby preventing a steel ruler and the like from being inserted in between a weather strip and a door window glass to release the door latch or the door lock actuator and reducing the number of assemblies in the door latch assembly.

It is another object of the present invention to provide a door latch cover for automotive vehicle adapted to improve a coupling force between a door latch cover and a door latch, thereby preventing the latch cover from being removed or moved from the door latch and also preventing an automotive vehicle from being stolen.

In accordance with the objects of the present invention, there is provided a door latch cover for automotive vehicle, the door latch cover fixedly arranged to encompass a door latch connected by a door lock actuator to be locked and to be unlocked and so constructed as to prevent the door latch from being actuated from outside through a door glass and a weather strip, wherein the door latch cover is integrally formed with an extended for blocking an upper part of the door lock actuator and for preventing the door actuator from being actuated from outside.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

An embodiment of the present invention will now be described in detail with reference to the accompanying drawings.

Figure 1:
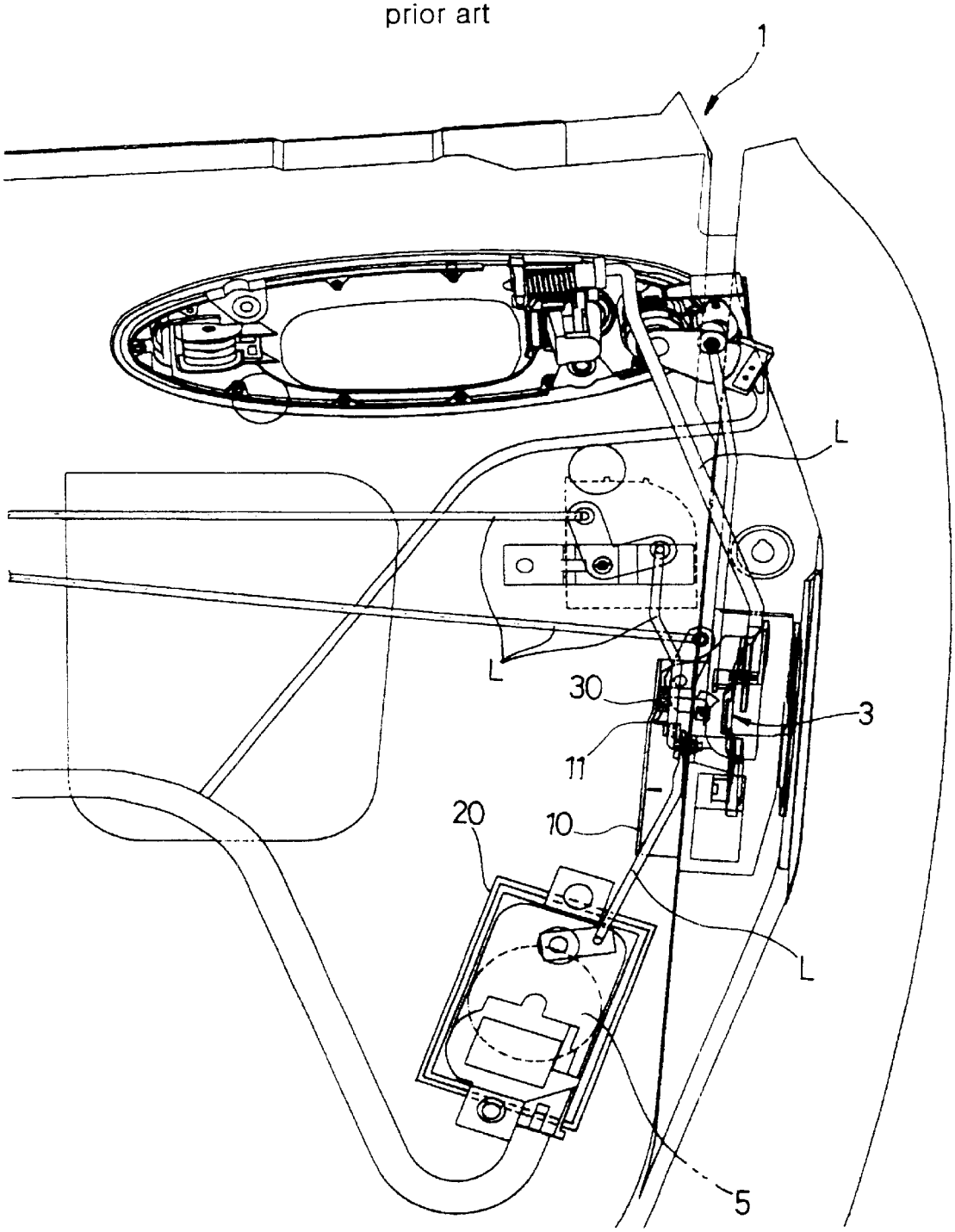
FIG. 1 prior art
FIG. 1 is a schematic diagram for illustrating an arranged state of a door latch assembly according to the prior art.
Figure 2A:
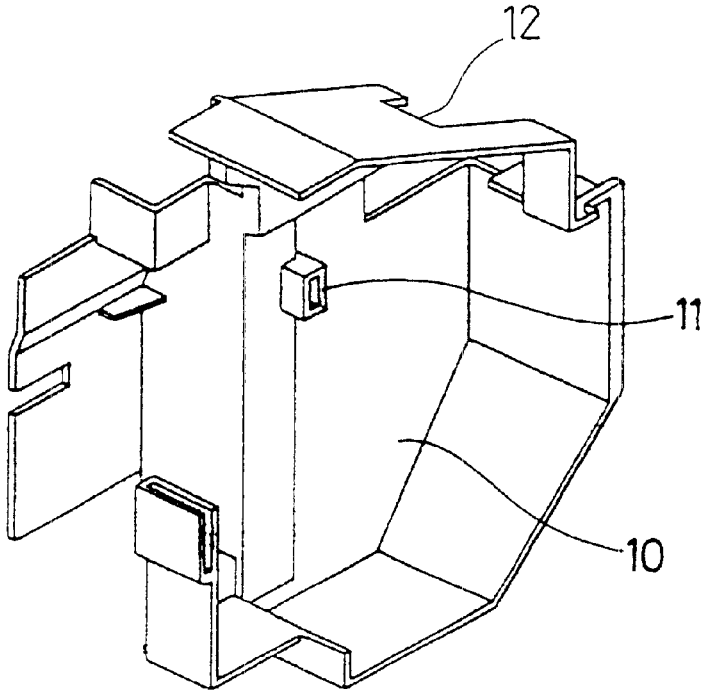
FIG.2a prior art
FIGS. 2*a* and 2*b* are perspective views each for illustrating a door latch cover and a door lock actuator shown in FIG. 1.
Figure 2B:
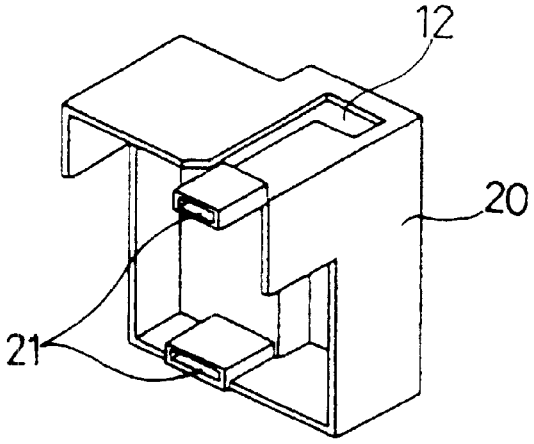
FIG.2b prior art
Figure 3:
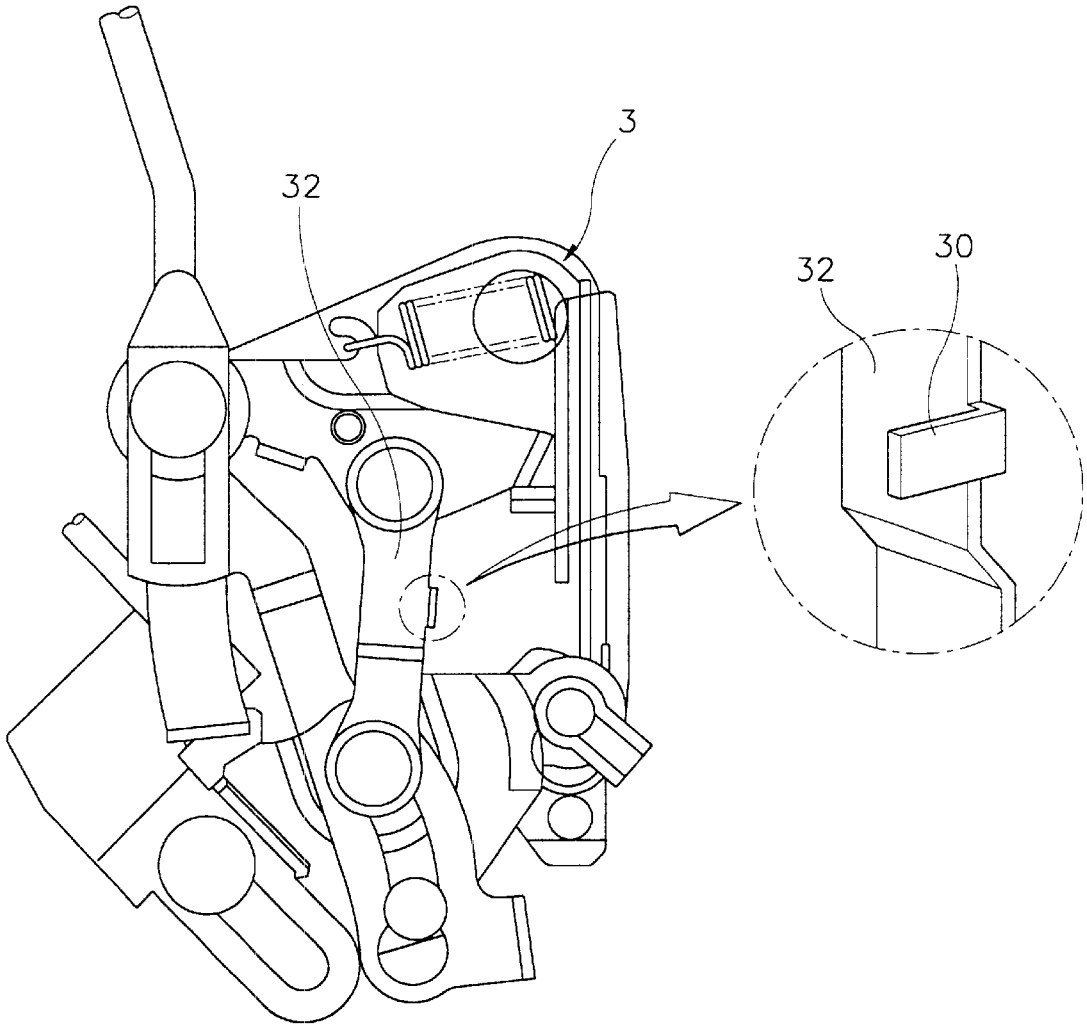
FIG.3 prior art
FIG. 3 is a partially enlarged view of a prouder of a door latch where the door latch cover in FIG. 2*a* is coupled.
Figure 4:
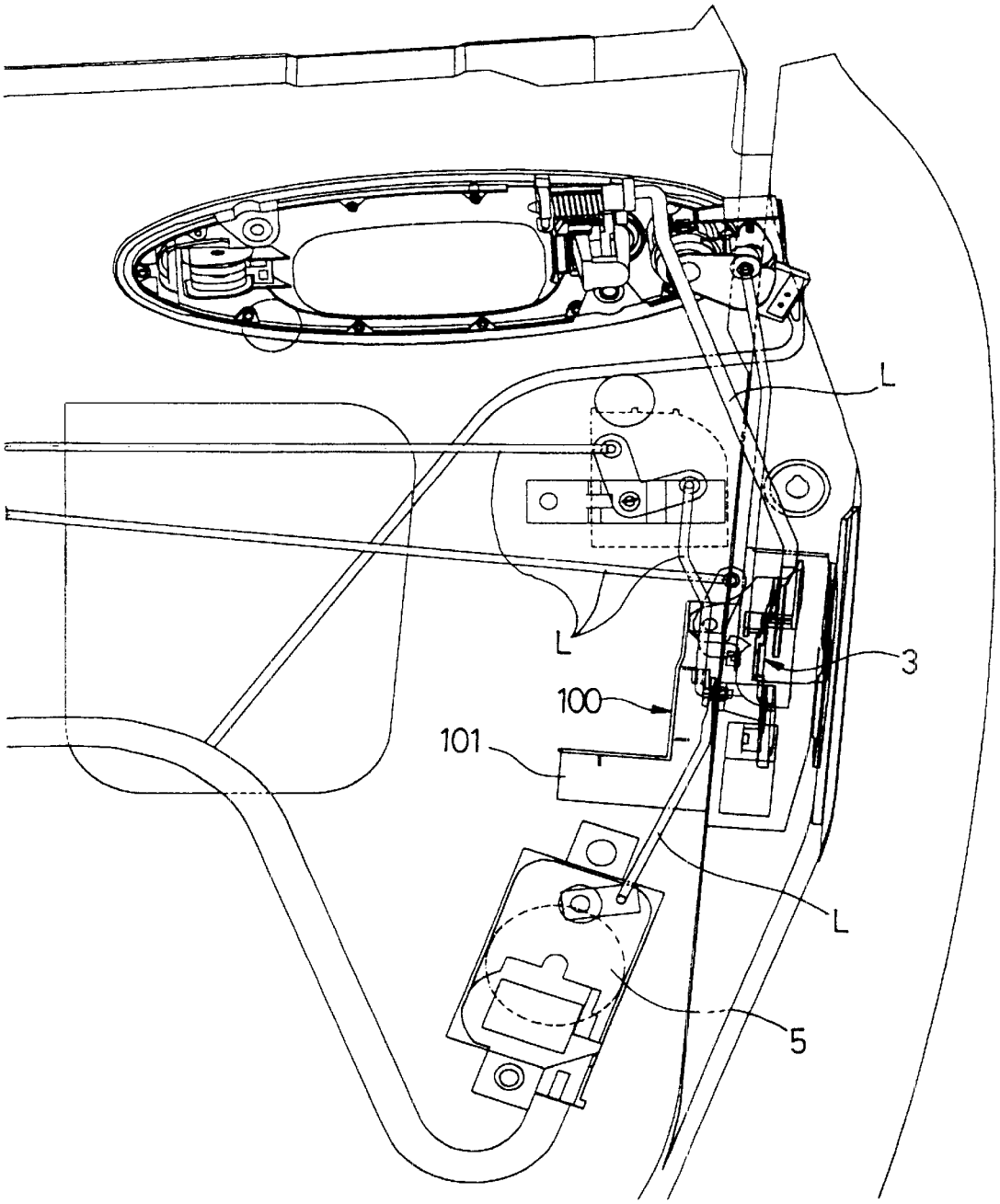
FIG. 4 is a schematic diagram for illustrating an installed state of a door latch cover according to the present invention.
Figure 5:
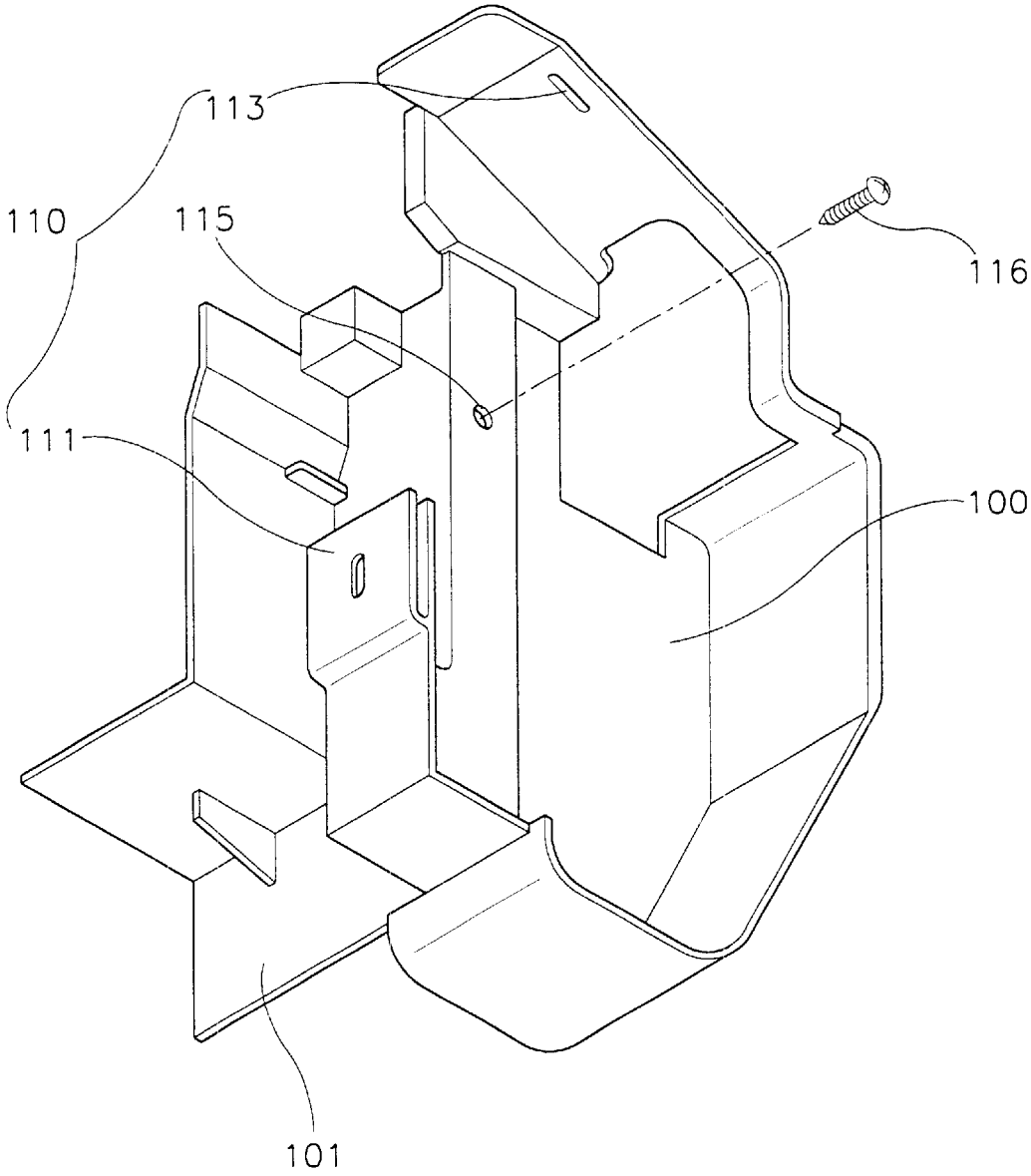
FIG. 5 is a perspective view for illustrating the door latch cover in FIG. 4.
Figure 6:
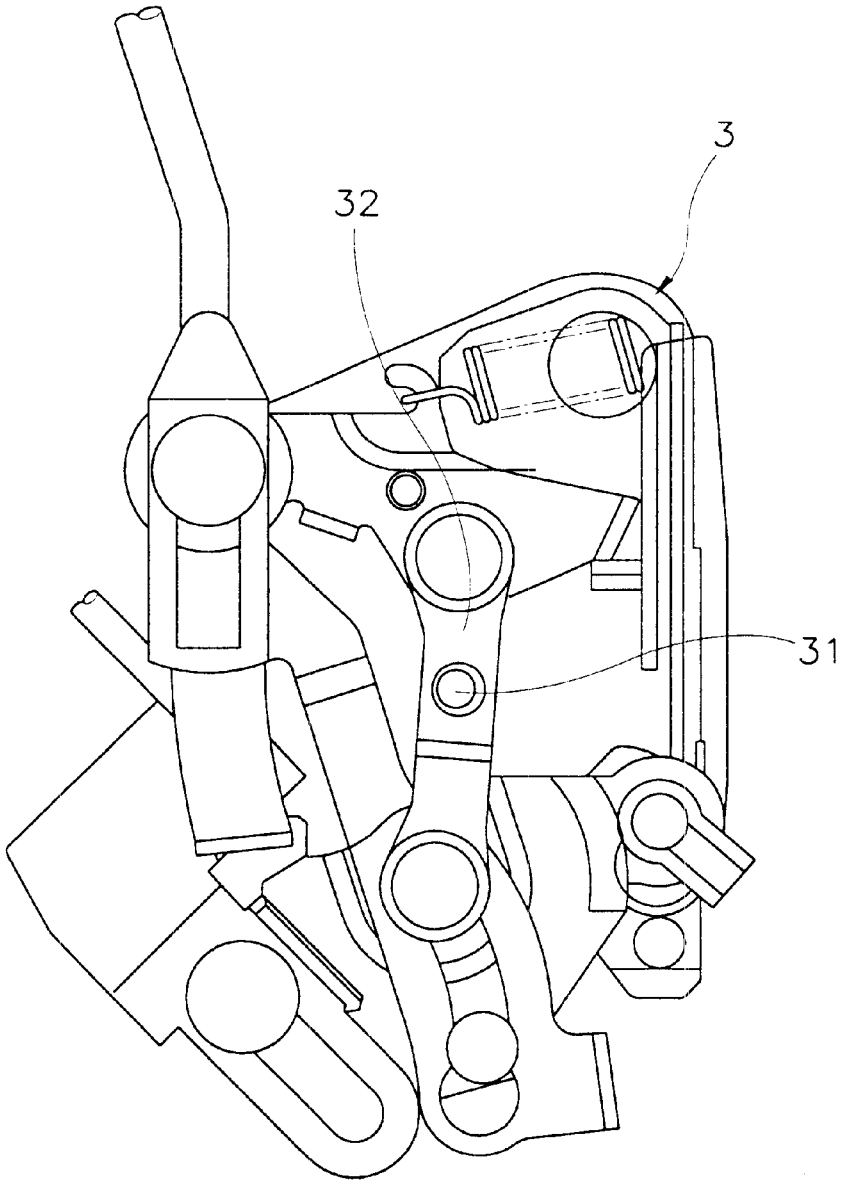
FIG. 6 is a schematic diagram for illustrating a formed state of a coupling hole at the door latch where the door latch cover is coupled according to FIG. 4.

FIG. 4 is a schematic diagram for illustrating an installed state of a door latch cover according to the present invention, FIG. 5 is a perspective view for illustrating the door latch cover in FIG. 4 and FIG. 6 is a schematic diagram for illustrating a formed state of a coupling hold at the door latch where the door latch cover is coupled according to FIG. 4, wherein a door 1 is connected therein by a door latch 3 and a door lock actuator 5 to a rod (L) and is also provided a door latch cover 100 to encompass the door latch 3 and to prevent interference with the rod (L).

Particularly, the door latch cover 100 is integrally formed with an extended 101 to cover an upper part of a door lock actuator 5. In other words, when the door latch cover 100 is coupled to the door latch 3, the door latch 3 cannot be actuated by a steel ruler or the like, and the extended 101 blocks an upper surface of the door lock actuator 5 to thereby prevent the door lock actuator 5 from being actuated.

Furthermore, the door latch cover 100 is injection-molded in synthetic resin or the like and is installed with clamping means 110 for increasing a coupling power with the door latch 3.

The clamping means 110 includes a fitting unit 111 formed at the door latch cover 100 for a protruder 30 formed at the door latch 3 to be downwardly fitted, and a fitting hole 113 formed at an upper side of the door latch cover 100 for a fitting piece (not shown) formed above the door latch 3 to be fitted.

In other words, the fitting hole 113 and the fitting unit 111 restrict the door latch 3 from upper and lower sides to avoid the door latch cover 100 from being disengaged from the door latch 3.

Furthermore, a coupling hole 31 is centrally formed at the door latch 3 in order to increase a coupling power of the door latch cover 100, and a through hole 115 is formed at the door latch cover 100 for a coupling member 116 screwed to the coupling hole 31 to pass therethrough, thereby increasing a coupling power of the door latch cover 100.

Now, the operational effect of the door latch cover thus constructed will be described.

The door lock actuator 5 is fixed in a door 1 while the door latch 3 is fixed at an upper side of the door lock actuator 5, in other words, at a position where the door latch 3 and a striker (not shown) are coupled.

When the door latch 3 is fixed, the door latch cover 100 is made to cover the door latch 3, and the protruder 30 and the fitting piece are fitted into the fitting unit 111 and the fitting hole 113 to thereby fix the door latch cover 100.

The installation is so arranged as to prevent an interference from being generated between the rod (L) and the door latch cover 100 when the door latch cover 100 is fixed to the door latch 3, such that the door latch 3 is blocked at an external side thereof by the door latch cover 100.

Furthermore, the coupling member 116 is screwed into the through hole 115 and the coupling hole 31 to further increase a coupling power of the door latch cover 100, such that the door latch 3 and the door latch cover 100 are tightly secured by the coupling member 116, thereby preventing separation from the door latch 3 caused by vibration of the vehicle or the like.

When the door latch 3 and the door latch cover 100 are combined, the extended 101 serves to block the upper side of the door lock actuator 5, such that door lock actuator cover 20 for encompassing the door lock actuator 5 is not separately needed as in the prior art, thereby simplifying the assembly.

In other words, only one door latch cover 100 can simultaneously block the door latch 3 and the door lock actuator 5, preventing the door latch 3 or the door lock actuator 5 from being actuated from outside through a space between a door glass and a weather strip.

By way of example, once the door is locked even if an odd object such as steel ruler or the like is inserted into a space between the door glass and the weather strip, the steel ruler is hitched by the door latch cover 100 and the extended 101 such that the door latch 3 and the door lock actuator 5 cannot be unlocked to thereby prevent the door 1 from being opened.

As apparent from the foregoing, there is an advantage in the door latch cover for automotive vehicle according to the present invention thus described in that, once a door is locked, a door latch and a door lock actuator are prevented from being forcibly unlocked from outside by odd object such as steel ruler or the like, thereby blocking an unlocking of the door and reducing the number of assembly process at the door latch assembly as well.

What is claimed is:

1. A door latch cover for automotive vehicle, the door latch cover fixedly arranged to encompass a door latch connected by a door lock actuator to be locked and to be unlocked and so constructed as to prevent the door latch from being actuated from outside through a door glass and a weather strip, wherein the door latch cover is integrally formed with an extended for blocking an upper part of the door lock actuator and for preventing the door lock actuator from being actuated from outside, the door latch cover further comprising:

a fitting unit formed at the door latch cover for a protruder formed at the door latch to be downwardly fitted;

a fitting hole formed at an upper side of the door latch cover for a fitting piece formed above the door latch to be fitted;

a coupling hole formed at the door latch;

a through hole formed therethrough to correspond with the coupling hole when the door latch and the door latch cover are coupled; and a coupling member for passing through the through hole to be screwed to the coupling hole for fixation thereof in order to increase a coupling force.

2. A door latch and cover for an automobile comprising:

a door latch;

a door lock actuator coupled to the door latch;

a protruding portion extending from the door latch;

a fitting piece extending from the door latch;

a cover covering the door latch;

an extended extending from the cover, blocking at least a part of the door lock actuator and preventing actuation of the door lock actuator from the outside of the automobile;

a fitting formed on the cover accommodating the protrusion; and a fitting hole formed on the cover accommodating the fitting piece.

3. The door latch and cover as defined in claim 2 wherein when protrusion is accommodated in the fitting and the fitting piece is accommodated in the fitting hole, the cover is fixed relative to the door latch.

4. The door latch and cover as defined in claim 2 further comprising:

a hole formed on the cover;

a corresponding hole formed on the door latch; and a fastener coupled to the hole on the cover and corresponding hole form on the door latch fastening the cover to the door latch.

* * * * *

UNITED STATES PATENT AND TRADEMARK OFFICE

CERTIFICATE OF CORRECTION

PATENT NO. : 6,471,266 B1
DATED : October 29, 2002
INVENTOR(S) : Bong-Chu Yi

It is certified that error appears in the above-identified patent and that said Letters Patent is hereby corrected as shown below:

Title page,
Item [57], ABSTRACT,
Line 7, replace “extended” with -- extender --

Column 4,
Line 16, replace “extended” with -- extender --
Line 39, replace “extended” with -- extender --

Signed and Sealed this

Ninth Day of March, 2004

JON W. DUDAS
*Acting Director of the United States Patent and Trademark Office*